US006708672B1

(12) United States Patent
Mueller et al.

(10) Patent No.: US 6,708,672 B1
(45) Date of Patent: Mar. 23, 2004

(54) FIXING DEVICE FOR AN INJECTION NOZZLE

(75) Inventors: Stephan Mueller, Leonberg (DE); Frank Ickinger, Pleidelsheim (DE); Michael Paul, Weissach (DE)

(73) Assignee: Porsche AG, Weissach (DE)

( * ) Notice: Subject to any disclaimer, the term of this patent is extended or adjusted under 35 U.S.C. 154(b) by 200 days.

(21) Appl. No.: 09/686,956

(22) Filed: Oct. 12, 2000

(30) Foreign Application Priority Data

Oct. 12, 1999 (DE) ..... 199 49 080

(51) Int. Cl.[7] ..... F02M 55/02
(52) U.S. Cl. ..... 123/470; 123/456
(58) Field of Search ..... 123/470, 468, 123/469, 472, 509, 456; 239/600

(56) References Cited

U.S. PATENT DOCUMENTS

| | | | | |
|---|---|---|---|---|
| 4,295,452 A | | 10/1981 | Lembke et al. | 123/470 |
| 4,909,221 A | * | 3/1990 | Heuser | 123/470 |
| 5,394,850 A | * | 3/1995 | Murphy et al. | 123/470 |
| 5,465,699 A | * | 11/1995 | Voigt | 123/470 |
| 5,682,859 A | * | 11/1997 | Wakeman | 123/470 |
| 5,718,205 A | * | 2/1998 | Jo | 123/470 |
| 6,148,797 A | * | 11/2000 | Gmelin | 123/456 |
| 6,263,863 B1 | * | 7/2001 | Giovannini et al. | 123/470 |

FOREIGN PATENT DOCUMENTS

| | | |
|---|---|---|
| DE | 28 29 057 | 1/1980 |
| DE | 34 15 780 | 10/1984 |
| DE | 44 18 001 | 12/1994 |
| DE | 196 28 326 | 1/1998 |
| DE | 197 35 665 | 1/1999 |

* cited by examiner

*Primary Examiner*—Carl S. Miller
(74) *Attorney, Agent, or Firm*—Crowell & Moring LLP

(57) ABSTRACT

A fixing device for an injection nozzle, in particular, for an injection nozzle of an internal combustion engine with direct fuel injection. The injection nozzle includes a nozzle holder body whose cylindrical first and second end pieces interact with a first and a second bore hole of components of the internal combustion engine. For easy mounting and leak-proof fastening of the injection nozzle, a clamping device acts upon the nozzle holder body. The clamping device holds in place, with a defined prestress, the first end piece in the first bore hole of a cylinder head. The second end piece preferably works together with the second bore hole of an intake arrangement, with the help of a reduction sleeve.

26 Claims, 4 Drawing Sheets

FIXING DEVICE FOR AN INJECTION NOZZLE

BACKGROUND AND SUMMARY OF THE INVENTION

This application claims the priority of German application 199 49 080.5, filed in Germany on Oct. 12, 1999, the disclosure of which is expressly incorporated by reference herein.

The invention relates to a fixing device for an injection nozzle, in particular, for internal combustion engines with direct fuel injection. The injection nozzle is of the type having a nozzle holder body whose cylindrical first and second end pieces interact with a first and a second bore hole which are worked into the components of the internal combustion engine.

A known injection nozzle, DE 44 18 001 A1, is set between a curved suction pipe and a flange connected to a cylinder head. Here, the injection nozzle is connected to the cylinder head as a pre-assembled unit.

In DE 28 29 057 A1 (corresponding to U.S. Pat. No. 4,295,452), injection valves are treated and inserted, on the one hand, into a suction equipment with the first end pieces, and on the other hand, by way of screws, connected to a fuel distributing pipe with the second end pieces.

One goal of the invention is to create a fixing device for an injection nozzle, which on the one hand, is leakproof even at relatively high injection pressures, and on the other, is easy to mount.

According to the invention, at least this goal is solved by incorporating a clamping device which acts upon a nozzle holder body of the injection nozzle, the clamping device keeping in place a first end piece of the nozle holder in a first bore hole of a cylinder head of the internal combustion engine with a defined prestress that acts in an axial direction of the injection nozzle, against which a second end piece of the nozzle holder, preferably with the help of a reduction sleeve, works together with the second bore hole of an intake arrangement.

The advantages of the invention that are mainly achieved are seen in the clamping device that keeps the injection nozzle in place with a defined prestress acting in an axial direction, on account of which the system pressure is taken into account, particularly in direct fuel injection for internal combustion engines of the Otto design, and special screws for each injection nozzle can be eliminated. The reduction sleeve also ensures that the manufacturing tolerances that constantly appear are not damaging to the connecting function of the injection nozzle. With the metallic clamping sleeve, which is easy to produce, a targeted prestress, aimed towards the cylinder head, can be effected also, thanks to the shock absorber. It is also possible for the reduction sleeve to be pre-assembled in a simple manner through the inward formations and the recesses between the clamping sleeve and reduction sleeve or the extension of the clamping sleeve and the wall section of the suction pipe equipment. The assembly of the injection nozzle itself is only a simple introductory process.

Other objects, advantages and novel features of the present invention will become apparent from the following detailed description of the invention when considered in conjunction with the accompanying drawings.

DETAILED DESCRIPTION OF THE DRAWINGS

Figure 1:
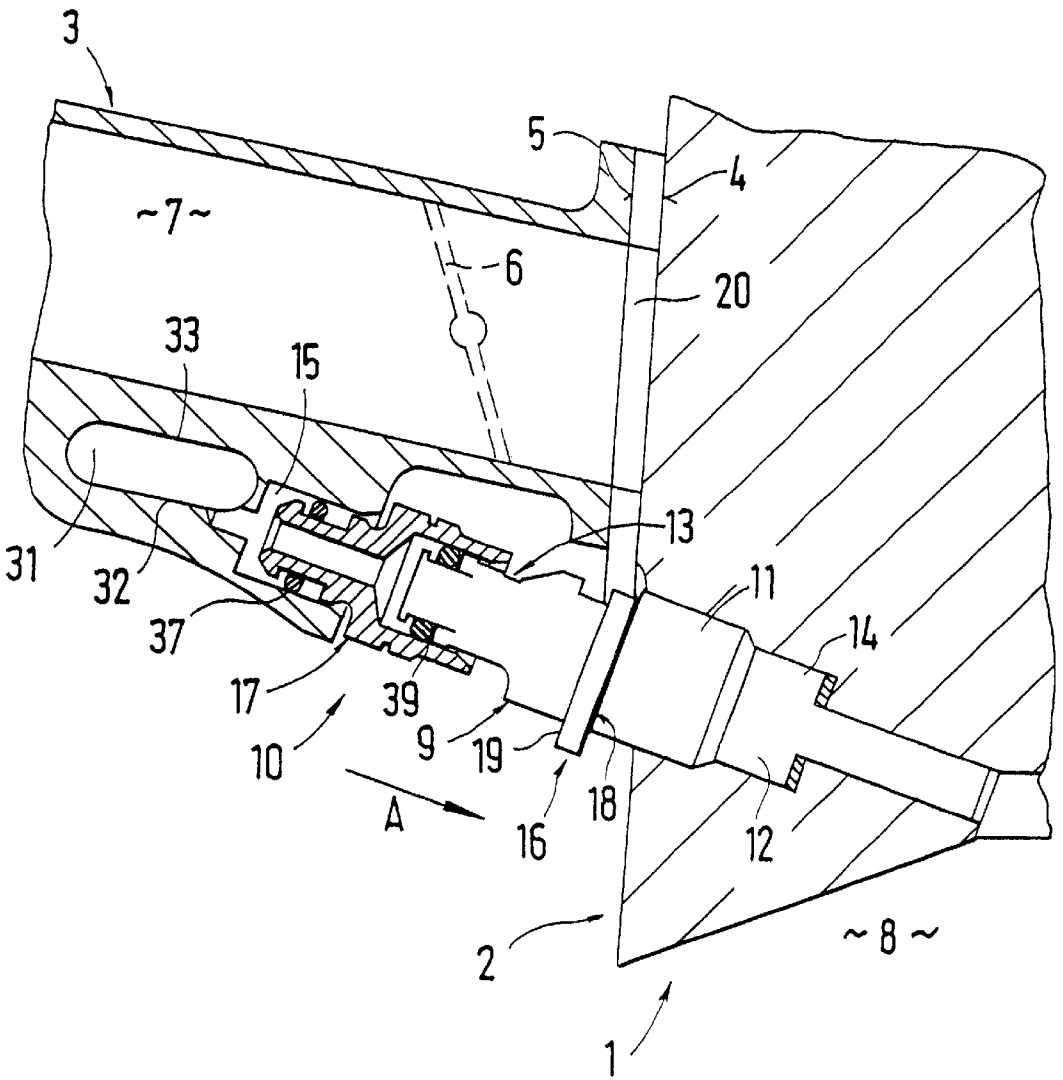
FIG. 1 is a partial cross sectional view of a cylinder head of an internal combustion engine with the fixing device according to the invention for an injection nozzle.
Figure 2:
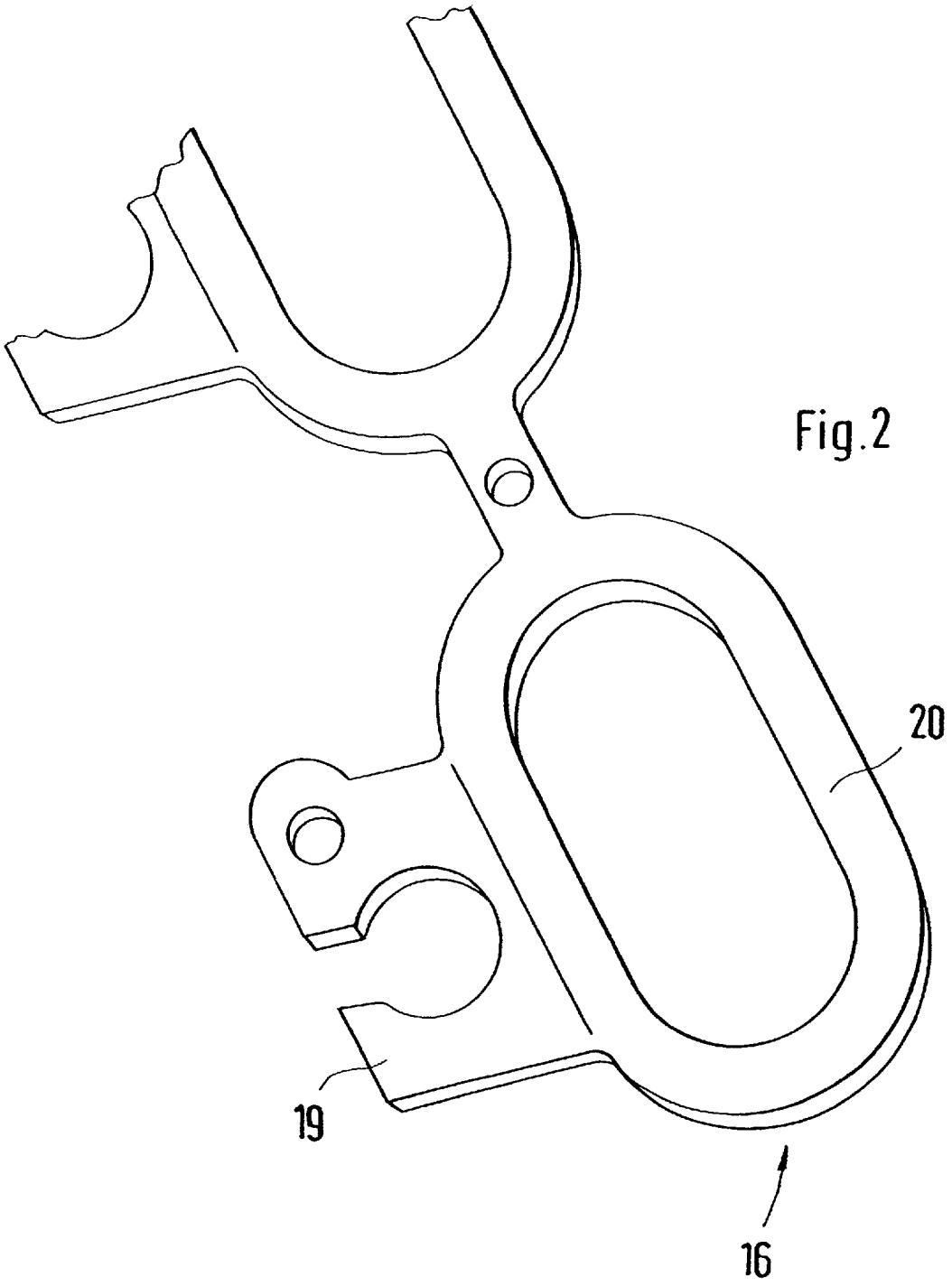
FIG. 2 is a perspective view showing a detail of FIG. 1 in a larger scale.

A multicylinder internal combustion engine 1 of the Otto design, not presented in greater detail, comprises, for instance, of a cylinder head 2 and an intake arrangement 3. The intake arrangement 3 is connected to the cylinder head 2, for which purpose the cylinder head 2 is provided with a first contact surface 4 and the intake arrangement 3 with a second contact surface 5. By means of the intake arrangement 3, fresh air is fed to a combustion chamber 8 through a conduit 7 provided with a butterfly valve 6. In this combustion chamber 8, motor fuel, i.e., gasoline, is fed using an injection nozzle 9, which means that the internal combustion engine works with direct fuel injection. In the cylinder head 2, intake and exhaust valves, which are not shown, are effective for gas-changing control-fresh air/waste gas.

For the injection nozzle 9, a fixing device 10 is provided, with the injection nozzle 9 exhibiting a nozzle holder body 11 with a first end piece 12 and a second end piece 13. The nozzle holder body 11 and the end pieces 12 and 13 exhibit a cylindrical configuration with a circular cross-section. The end pieces 12 and 13 interact with a first bore hole 14 and a second bore hole 15, which are worked into the components of the internal combustion engine 1. These components are formed by the cylinder head 2 and the intake arrangement 3.

A clamping device 16 acts upon the nozzle holder body 11 of the injection nozzle 9, which clamping device 16 holds—with a defined prestress that acts in an axial direction A—the first end piece 12 in the first bore hole 14 in the cylinder head 2. In comparison, the second end piece works together with the second bore hole 15 in the intake arrangement 2 through the intermediary of a reduction sleeve 17. The clamping device 16 acts upon a radial catch 18 of the nozzle holder body 11. To this end, the clamping device 16 is provided with a bifurcated clamping section 19, which is adjacent to the catch 18. The clamping section 19 of the clamping device 16 is a component of a plate-like support 20, which is clamped between the first contact surface 4 of the cylinder head 2 and the second contact surface 5 of the intake arrangement 3 and is held in place.

Figure 3:
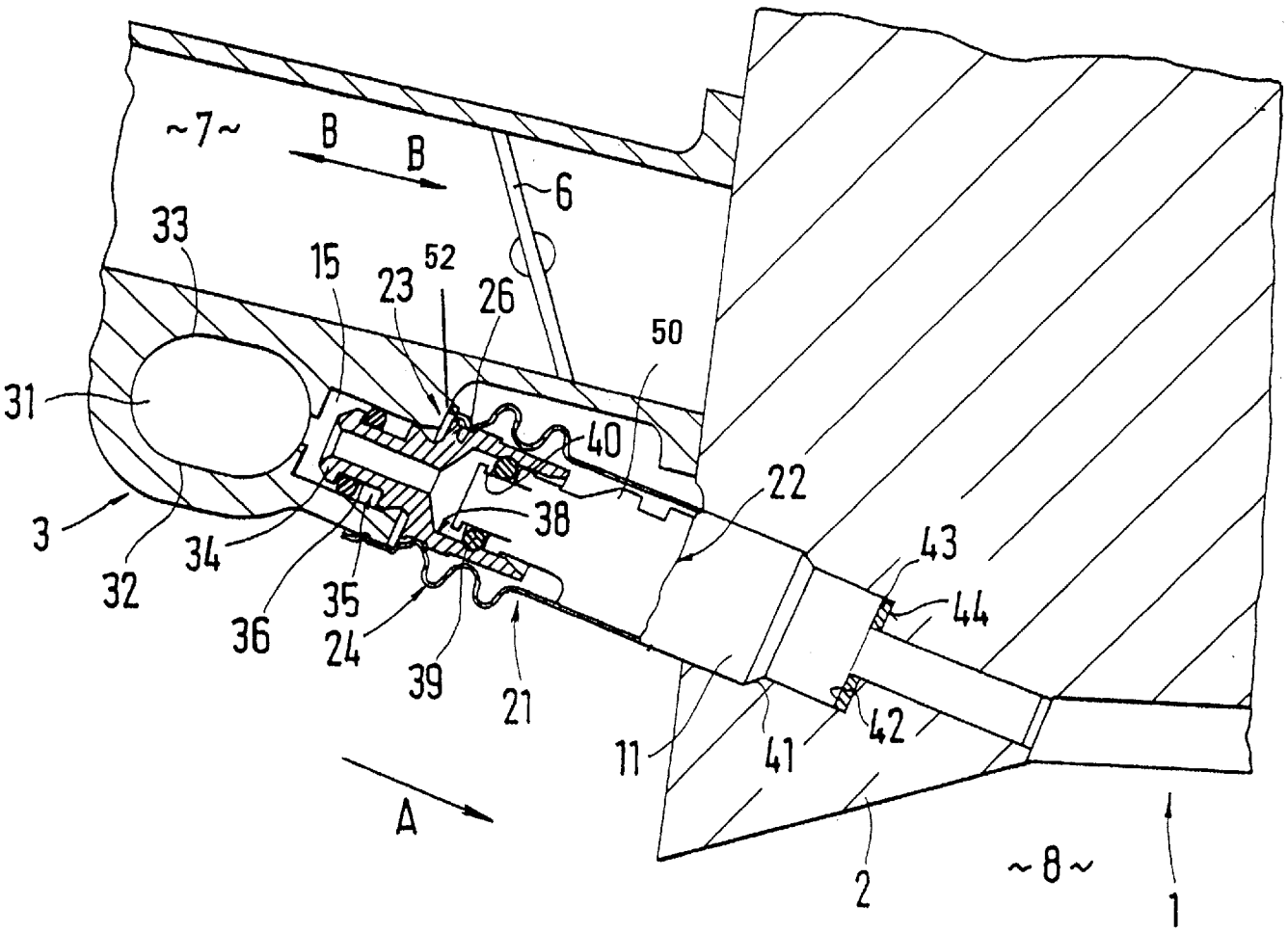
FIG. 3 is a view corresponding to FIG. 2 with another form of embodiment.

According to FIG. 3, the clamping device is a clamping sleeve 21, which coaxially, and like a casing, surrounds the nozzle holder body 11 of the injection nozzle 9 in a partial area 22; another partial area 23 of the nozzle holder body 11 is exposed. The clamping sleeve 21 is propped, on the one hand, on a buffer 50 of the nozzle holder body 11, and on the other hand, on a support plane 52 of the intake arrangement 3. The clamping sleeve 21 consists of a suitable metal with spring characteristics. Manufacturing the clamping sleeve 21 from an appropriate synthetic material is also conceivable. To obtain a targeted clamp force, the clamping sleeve 21 encircles sector by sector a bellows-like spring section 24, which is provided next to the support plane 3 of the intake arrangement 3.

Figure 4:
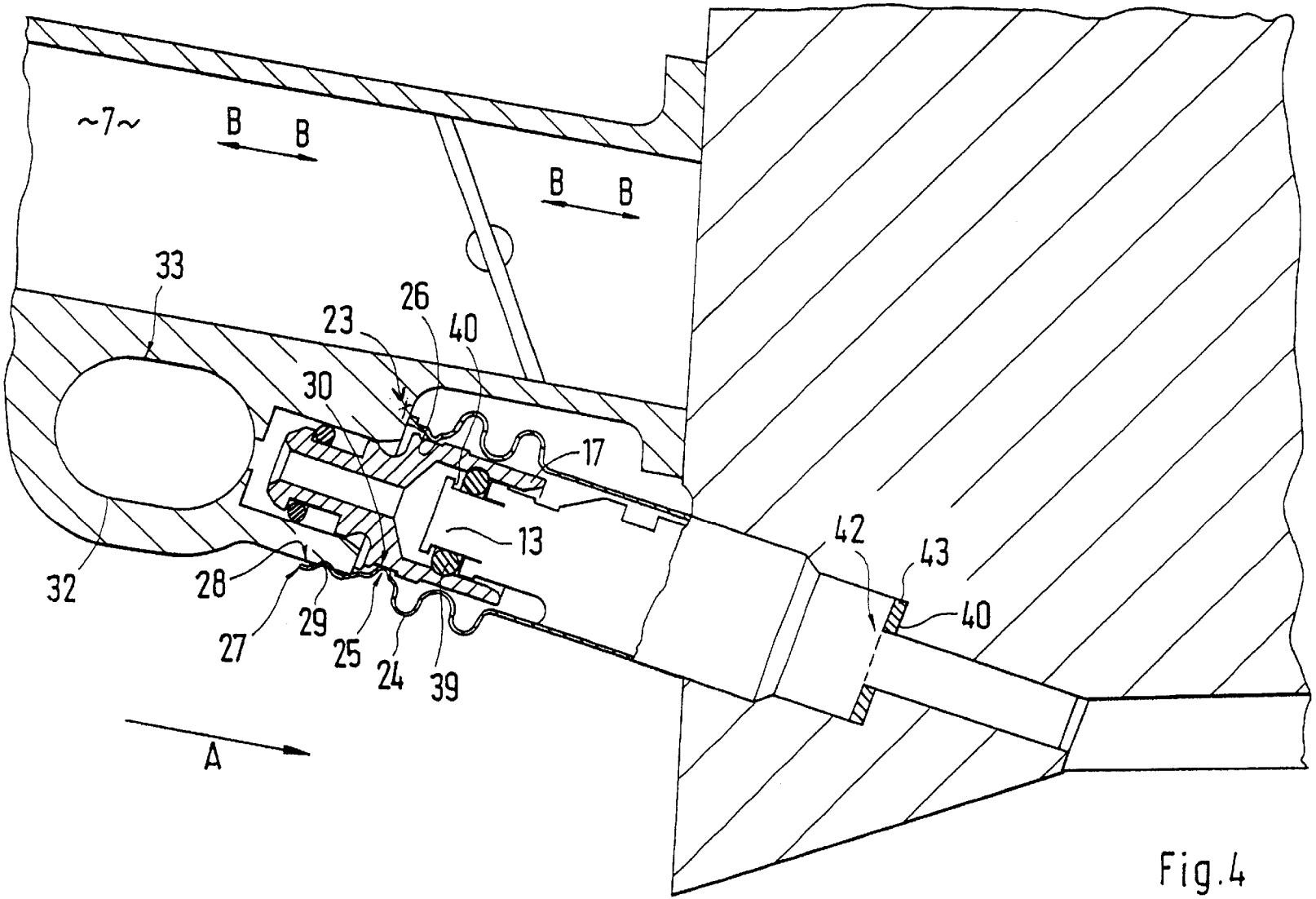
FIG. 4 is a view of a detail of FIG. 3 in a larger scale.

According to FIG. 4, in the area of the reduction sleeve 17, the clamping sleeve 21 exhibits an inward formation 25, which flexibly engages in a groove-like recess 26 of the said reduction sleeve 17. As a result, the inward formation 25 and the recess 26 work together in a form- and force-locking manner. Moreover, the clamping sleeve 21 is provided with an extension 27 that overlaps a wall section 28 of the intake arrangement 3 and rests against this wall section while under spring tension. The extension 27 has an inward formation 29, which engages in an outward formation 30 of the wall section 28, as a result of which the inward formation 29 and the outward formation 30 work together in a form-locking manner.

The intake arrangement 3 is provided with a fuel supply conduit 31 next to the reduction sleeve 17, said fuel supply conduit being made of one piece with the intake arrangement 3. From a cross-sectional view, the fuel supply conduit 31 exhibits an oval shape with side walls 32, 33, which are aligned in more or less longitudinal direction B—B of the conduit 7 or of a medium length plane of the latter.

An end piece 34, which rests in the second bore hole 15 of the intake arrangement 3, and is turned towards the intake arrangement 3, is provided on the reduction sleeve 17. The end piece 34 is provided on its exterior 35 with a recess 36, which is developed as a receptacle for a first sealing 37. The sealing 37 is effective between borehole 15 and reduction sleeve 17 or recess 36. A comparable execution is arranged on the second end piece 13 of the nozzle holder body 11. The second end piece 13 rests in a bore hole 38 of the reduction sleeve 17 and it exhibits a recess 40 that serves as a receptacle for a second sealing 39. The sealing 39 is operative between the borehole 38 and the end piece 13 or of the recess 40.

The injection nozzle 9 is consequently stored on the side of the intake arrangement 3 in such a way that it compensates for tolerance. In comparison, the injection nozzle 9 is set position-wise on the side of the cylinder head 2 by means of conical surfaces 41, in the course of which the injection nozzle 9, at a distance to the conical surfaces 41, is provided with a radial stopping face 42, which is propped on a corresponding stopping surface 44 of the cylinder head 2, by means of a sealing body 43.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Fixing device for an injection nozzle of an internal combustion engine with direct fuel injection, said injection nozzle including a nozzle holder body having cylindrical first and second end pieces which interact with a first and a second bore hole of components of the internal combustion engine, wherein a clamping device acts upon the nozzle holder body of the injection nozzle, said clamping device keeping in place the first end piece in the first bore hole of a cylinder head of the internal combustion engine with a defined prestress that acts in the axial direction of the injection nozzle, and said second end piece being operatively supported at the second bore hole, wherein the clamping device acts upon a radial catch of the nozzle holder body, wherein the clamping device rests against the catch with a bifurcated clamping section, and wherein the clamping section is a component of a plate-like support, which is clamped between a first contact plane of the cylinder head and a second contact plane of an intake arrangement forming a component of the internal combustion engine.

2. Fixing device for an injection nozzle of an internal combustion engine with direct fuel injection, said injection nozzle including a nozzle holder body having cylindrical first and second end pieces which interact with a first and a second bore hole of components of the internal combustion engine, wherein a clamping device acts upon the nozzle holder body of the injection nozzle, said clamping device keeping in place the first end piece in the first bore hole of a cylinder head of the internal combustion engine with a defined prestress that acts in the axial direction of the injection nozzle, and said second end piece being operatively supported at the second bore hole, and wherein a fuel supply conduit is provided next to a reduction sleeve operatively supporting the second end piece at the second bore hole in an intake arrangement forming a component of the internal combustion engine, said fuel supply conduit being made of one piece with the intake arrangement.

3. Fixing device according to claim 2, wherein the fuel supply conduit has a substantially oval shape in which side walls of the fuel supply conduit are aligned substantially along a longitudinal direction of a conduit of the intake arrangement.

4. Fixing device for an injection nozzle of an internal combustion engine with direct fuel injection, said injection nozzle including a nozzle holder body having cylindrical first and second end pieces which interact with a first and a second bore hole of components of the internal combustion engine, wherein a clamping device acts upon the nozzle holder body of the injection nozzle, said clamping device keeping in place the first end piece in the first bore hole of a cylinder head of the internal combustion engine with a defined prestress that acts in the axial direction of the injection nozzle, and said second end piece being operatively supported at the second bore hole, and wherein a first sealing is provided between an end piece of a reduction sleeve operatively supporting the second end piece and the second bore hole of an intake arrangement forming a component of the internal combustion engine, and a second sealing is provided between a bore hole in the reduction sleeve and the second end piece of the injection nozzle.

5. Fixing device for an injection nozzle of an internal combustion engine with direct fuel injection, said injection nozzle including a nozzle holder body having cylindrical first and second end pieces which interact with a first and a second bore hole of components of the internal combustion engine, wherein a clamping device acts upon the nozzle holder body of the injection nozzle, said clamping device keeping in place the first end piece in the first bore hole of a cylinder head of the internal combustion engine with a defined prestress that acts in the axial direction of the injection nozzle, and said second end niece being operatively supported at the second bore hole, and wherein the second end piece is operatively supported at the second bore hole with a reduction sleeve.

6. Fixing device according to claim 5, wherein the second bore hole is located in an intake arrangement forming a component of the internal combustion engine.

7. A fixing device for an injection nozzle of an internal combustion engine having direct fuel injection, the injection nozzle including a nozzle holder body having a cylindrical first end piece interacting with a first bore hole of a component of the internal combustion engine and a cylindrical second end piece interacting with a second bore hole of another component of the internal combustion engine, comprising:

a clamping device operatively arranged to act upon the nozzle holder body of the injection nozzle such that the first end piece is held in place in the first bore hole located in a cylinder head with a defined prestress that acts in an axial direction of the injection nozzle and the second end piece is held in the second bore hole located in an intake arrangement by way of a reduction sleeve.

8. Fixing device according to claim 7, wherein the clamping device acts upon a radial catch of the nozzle holder body.

9. Fixing device according to claim 8, wherein the clamping device rests against the catch with a bifurcated clamping section.

10. Fixing device according to claim 9, wherein the clamping section is a component of a plate-like support, which is clamped between a first contact plane of the cylinder head and a second contact plane of the intake arrangement.

11. Fixing device according to claim 7, wherein the clamping device is a clamping sleeve which encircles the nozzle holder body of the injection nozzle at least sector by sector and rests on a catch of the nozzle holder body and on a support plane of the intake arrangement.

12. Fixing device according to claim 7, wherein the clamping sleeve is made of metal.

13. Fixing device according to claim 11, wherein the clamping sleeve includes a bellows-like spring section.

14. Fixing device according to claim 11, wherein the clamping sleeve, in the area of the reduction sleeve, is provided with an inward formation, which engages in a groove-like recess of the reduction sleeve in such a way that the inward formation and the recess work together in a form- and force-locking manner.

15. Fixing device according to claim 11, wherein the clamping device overlaps a wall section of the intake arrangement with an extension that, while under spring tension, rests against the wall section.

16. Fixing device according to claim 15, wherein the extension is provided with an inward formation, which engages in an outward formation of the wall section such that the inward formation and the recess work together in an interlocking manner.

17. Fixing device according to claim 7, wherein a fuel supply conduit is provided next to the reduction sleeve in the intake arrangement, said fuel supply conduit being made of one piece with the intake arrangement.

18. Fixing device according to claim 17, wherein the fuel supply conduit has a substantially oval shape in which side walls of the fuel supply conduit are aligned substantially along a longitudinal direction of a conduit of the intake arrangement.

19. Fixing device according to claim 7, wherein a first sealing is provided between an end piece of the reduction sleeve and the second bore hole of the intake arrangement, and a second sealing is provided between a bore hole in the reduction sleeve and the second end piece of the injection nozzle.

20. Fixing device according to claim 14, wherein the clamping device overlaps a wall section of the intake arrangement with an extension that, while under spring tension, rests against the wall section.

21. Fixing device according to claim 11, wherein a fuel supply conduit is provided next to the reduction sleeve in the intake arrangement, said fuel supply conduit being made of one piece with the intake arrangement.

22. A fixing device for an injection nozzle of an internal combustion engine having direct fuel injection, the injection nozzle including a nozzle holder body having a cylindrical first end piece interacting with a first bore hole of a component of the internal combustion engine and a cylindrical second end piece interacting with a second bore hole of another component of the internal combustion engine, comprising:

a clamping means for holding the first end piece of the nozzle holder body in the first bore hole of a cylinder head with a defined prestress that acts in an axial direction of the injection nozzle and for holding the second end piece of the nozzle holder body in the second bore hole located in an intake arrangement.

23. Fixing device according to claim 22, wherein the clamping means acts upon a radial catch of the nozzle holder body.

24. Fixing device according to claim 23, wherein the clamping means rests against the catch with a bifurcated clamping section.

25. Fixing device according to claim 24, wherein the clamping section is a component of a plate-like support, which is clamped between a first contact plane of the cylinder head and a second contact plane of the intake arrangement.

26. Fixing device according to claim 22, wherein the clamping means is a clamping sleeve which encircles the nozzle holder body of the injection nozzle at least sector by sector and rests on a catch of the nozzle holder body and on a support plane of the intake arrangement.

* * * * *